US006567722B1

(12) United States Patent
Menke

(10) Patent No.: US 6,567,722 B1
(45) Date of Patent: May 20, 2003

(54) DEVICE FOR STORING AND ISSUING BANKNOTES

(75) Inventor: Wilhelm Menke, Bingen am Rhein (DE)

(73) Assignee: NSM Aktiengesellschaft, Bingen am Rhein (DE)

( * ) Notice: Subject to any disclaimer, the term of this patent is extended or adjusted under 35 U.S.C. 154(b) by 0 days.

(21) Appl. No.: 09/423,561

(22) PCT Filed: Mar. 8, 1999

(86) PCT No.: PCT/EP99/01488

§ 371 (c)(1),
(2), (4) Date: May 22, 2000

(87) PCT Pub. No.: WO99/46739

PCT Pub. Date: Sep. 16, 1999

(30) Foreign Application Priority Data

Mar. 11, 1998 (DE) ..... 198 10 542
Aug. 3, 1998 (DE) ..... 198 34 981
Sep. 15, 1998 (DE) ..... 198 42 267

(51) Int. Cl.[7] ..... B65H 29/00

(52) U.S. Cl. ..... 700/223; 194/206; 271/9.08; 271/287; 271/292; 271/294

(58) Field of Search ..... 700/223; 271/9.08, 271/279, 287, 292, 294; 194/206

(56) References Cited

U.S. PATENT DOCUMENTS 1,976,893 A * 10/1934 Shomaker ..... 271/164
3,108,693 A * 10/1963 Patzer ..... 194/207
3,258,098 A * 6/1966 Hooker ..... 194/206
3,608,690 A 9/1971 Morrow et al.
4,050,562 A * 9/1977 Schwippert et al. ..... 194/261
4,169,674 A * 10/1979 Russel ..... 355/14
4,363,584 A * 12/1982 Kokubo ..... 194/206
4,437,660 A * 3/1984 Tompkins et al. ..... 271/290
4,629,382 A * 12/1986 Ueshin ..... 414/48
4,807,865 A * 2/1989 Kobler et al. ..... 270/52.22
4,840,365 A * 6/1989 Kobler et al. ..... 270/52.19
4,871,159 A * 10/1989 Petersen ..... 270/52.19
4,878,799 A * 11/1989 Seto et al. ..... 187/255
4,930,765 A * 6/1990 Russel et al. ..... 271/214
5,076,413 A 12/1991 Davila et al.
5,108,081 A * 4/1992 Russel et al. ..... 270/37
5,152,517 A * 10/1992 Ruch et al. ..... 271/162
5,165,571 A * 11/1992 Schlumpf ..... 194/346
5,180,158 A * 1/1993 Coombs ..... 271/293
5,182,722 A * 1/1993 Hain ..... 364/551.01
5,350,268 A * 9/1994 Muller ..... 412/1
5,435,544 A * 7/1995 Mandel ..... 271/298
5,632,479 A * 5/1997 Kubota et al. ..... 271/296
5,836,577 A * 11/1998 Arikawa et al. ..... 270/58.04
5,882,005 A * 3/1999 Araseki et al. ..... 271/126
6,021,883 A * 2/2000 Casanova et al. ..... 194/217
6,022,011 A * 2/2000 Hirose ..... 270/37
6,189,881 B1 * 2/2001 Bolton et al. ..... 271/122

FOREIGN PATENT DOCUMENTS

| | | |
|---|---|---|
| DE | 3136610 | 3/1983 |
| DE | 4005291 | 8/1990 |
| GB | 2236143 | 3/1991 |

* cited by examiner

*Primary Examiner*—Donald P. Walsh
*Assistant Examiner*—Jeffrey A Shapiro
(74) *Attorney, Agent, or Firm*—Dilworth & Barrese LLP

(57) ABSTRACT

The invention relates to an apparatus for storage and dispensing of bank notes, preferably having a device connected in series to verify genuineness of bank notes inserted. To provide the apparatus which is characterized by a simple and therefore economical performance construction with the required security of pay-out, a compartment module having components lying next to each other, separated from each other by partitions and opened at their end sides is provided which is guided moveably by a controlled drive. To store the bank notes, a slider travelable to and fro by a controlled drive is guided in the housing in the transverse middle plane of the bank note supplied in each case, this slider pushing the bank notes while folding them in the middle in a loop-like manner into a compartment of the compartment module traveling into the middle plane.

11 Claims, 9 Drawing Sheets

DEVICE FOR STORING AND ISSUING BANKNOTES

The invention relates to an apparatus for the storage and dispensing of bank notes, preferably having a device connected in series to verify the genuineness of bank notes inserted.

BACKGROUND OF THE INVENTION

Apparatuses for the storage and dispensing of bank notes are known, for example, in the form of the cash dispensers operated by banks which dispense monetary amounts within the existing credit limit after the insertion of credit or cheque cards and after entering a PIN number. Such cash dispensers are, however, very complex. With gambling machines, for example, there is a need to pay out monetary amounts up to, for example, DM 200.00 after winning as part of a special game series; this is currently generally done by paying out coins. However, to avoid the pay-out of a large number of coins, there is a need to pay out large amounts using bank notes from gambling machines, too, particularly if the gambling machines are also designed to accept notes to deposit the game credit. However, only those apparatuses for the dispensing of bank notes can be considered for gambling machines which can be manufactured at a favourable cost.

SUMMARY OF THE INVENTION

It is therefore the object of the invention to provide an apparatus of the type first given which is characterised by a simple and therefore economically performable construction with the required security of pay-out.

This object is solved in accordance with the invention with an apparatus of the type first given by a compartment module having components lying next to each other, separated from each other by partitions and open at their end sides in the form of a block being guided in the guides of a housing movably backwards and forwards by a controlled drive, by a conveying device or slide feeding the flat bank notes opening in front of a side forming the insertion side of the compartment module, by a slider travellable to and fro by a controlled drive being guided in the housing for the storage of the bank notes in the transverse middle plane of the bank note supplied in each case, which slider pushes the bank notes while folding them in the middle in a loop-like manner into a compartment of the compartment module travelled into the middle plane, and—for the dispensing of a bank note—by the compartment storing this bank note being travelled in front of a dispensing device into which an extraction device, for example a controlled gripper or slider, feeds the bank note stored in this compartment.

The apparatus in accordance with the invention can be implemented in a simple design and is essentially characterised by a compartment module guided movably in a housing in whose compartments the bank notes are stored ordered by value in a form folded over in a loop-like manner. For their storage, the bank notes can be inserted easily into the compartments by a slider. The dispensing is performed in a correspondingly simple manner by an extraction device or a gripper which extracts the bank note demanded for dispensing in each case from its compartment travelled to the dispensing position and places it in the dispensing device.

Appropriately, a drive carrier is provided for the mounting of the slider. Here, the individual compartments of the compartment module have such a wide width that the swivel lever does not catch therein.

BRIEF DESCRIPTION OF THE DRAWINGS

In accordance with a preferred aspect, it is provided that the dispensing device comprises an extraction roller pair. Here, the dispensing slot or slit can be located directly behind the extraction toiler pair. If, however, the dispensing slot is further away from the extraction roller pair, then behind the extraction roller pair there is connected a conveying device which can comprise, for example, driven toothed belts under which the bank notes folded in the middle can be transported. Here, the driven toothed belts disposed in parallel next to each other are guided over a metal plate so that the folded note is transported between the metal plate and the two belts. By means of the conveying device it is thus possible to position the dispensing slot at different points of the relevant housing depending on the application. On the one hand, the dispensing and insertion of the bank notes can be performed using the same slot. Furthermore, it is possible that a separate dispensing slot and a separate insertion slot exist, with the dispensing of the bank notes taking place at a dispensing slot located underneath the insertion slot. The dispensing of the bank notes can, however, also take place at a point remote from the insertion slot, e.g. in a pay-out cup.

DESCRIPTION OF THE PREFERRED EMBODIMENTS

Appropriately, drives controlled by a microprocessor are provided for the compartment module, the slider and the extraction device for the bank notes.

In accordance with another preferred aspect, it is provided that the apparatus in accordance with the invention for the storage and dispensing of bank notes can be coupled to a bank note tester known per se. The intake apparatus for the bank notes is here designed in such a way that the bank notes pass the corresponding bank note tester along their transportation path and are verified accordingly there.

Figure 1:
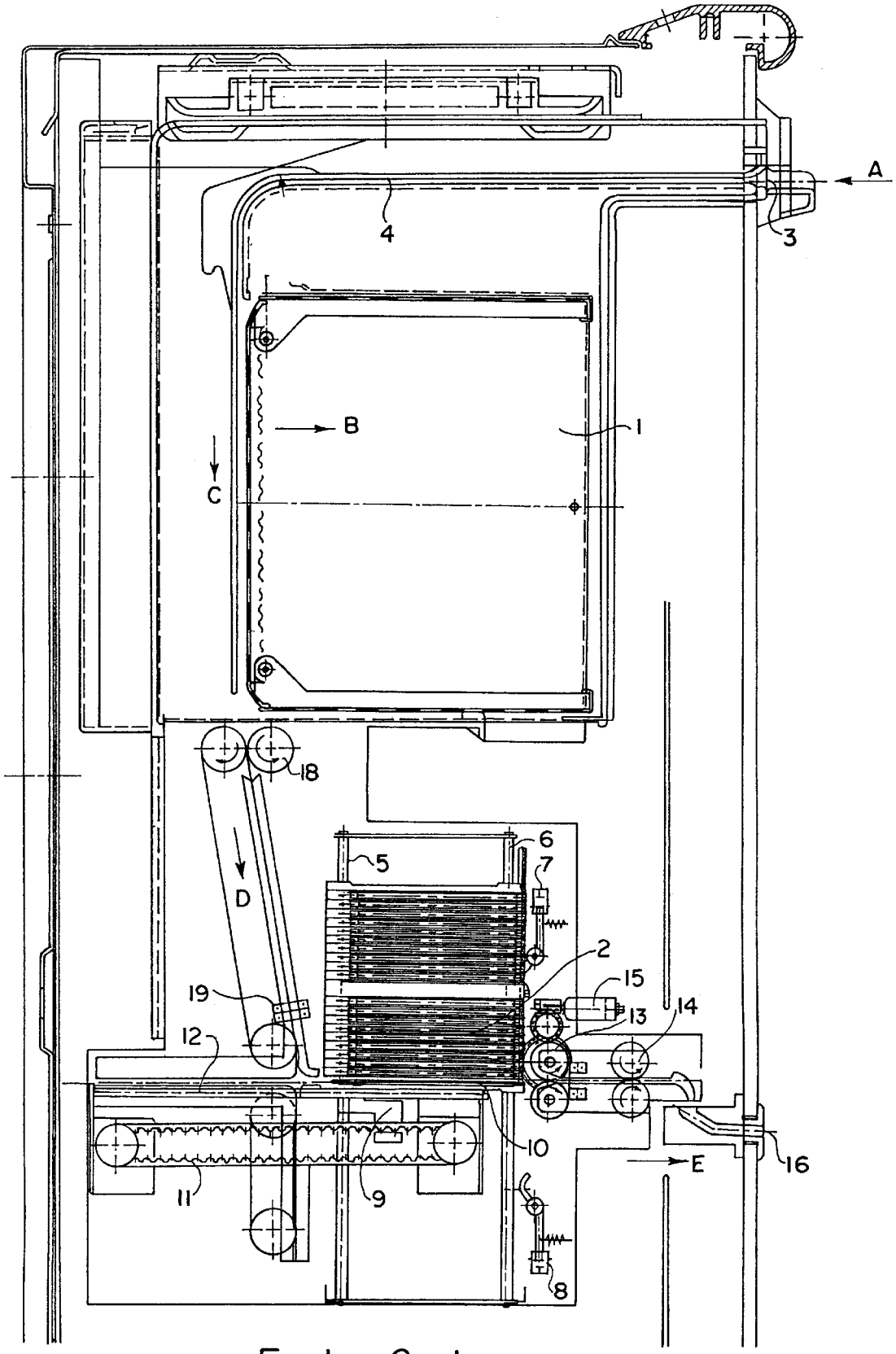
Figure 2:
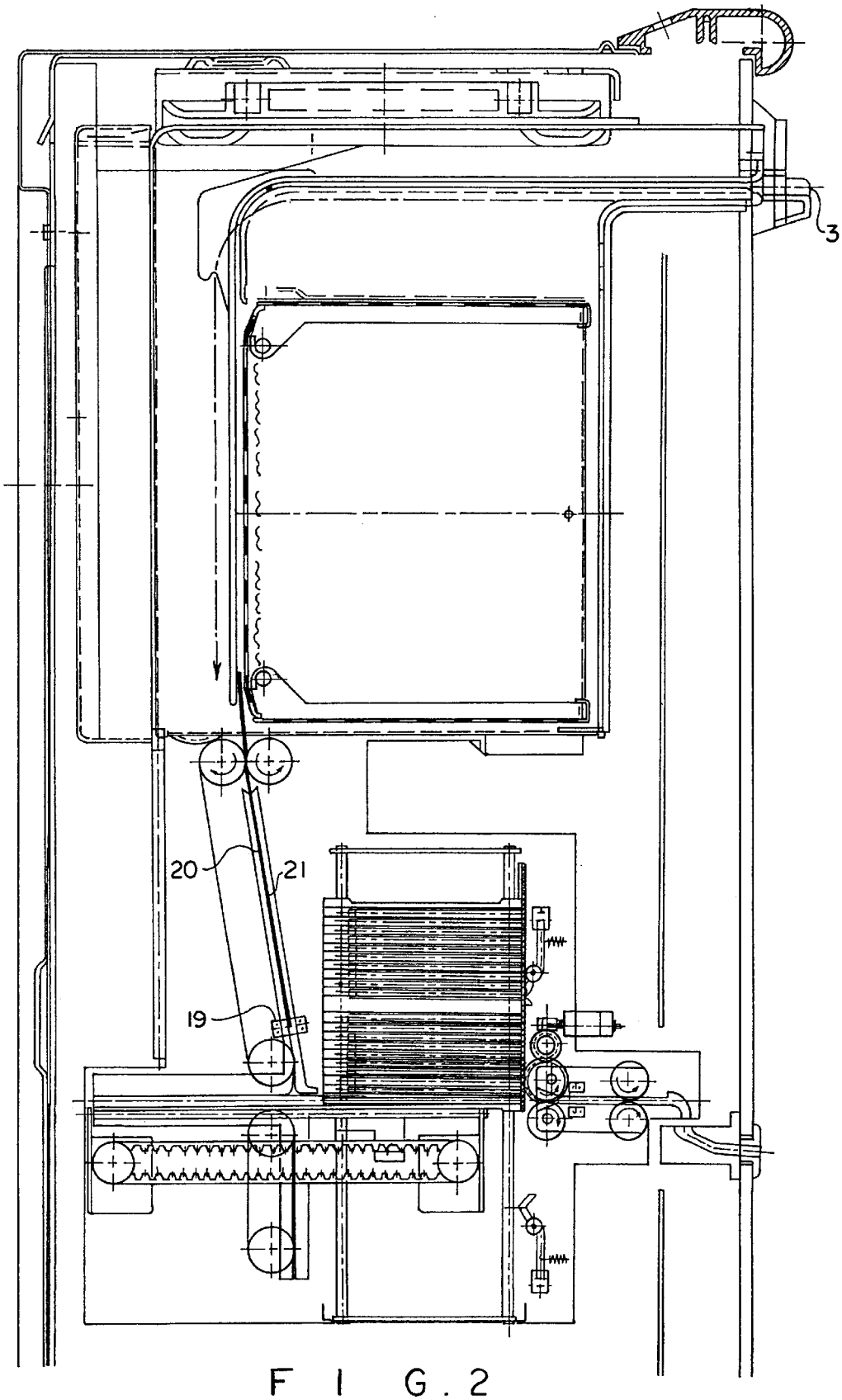
Figure 3:
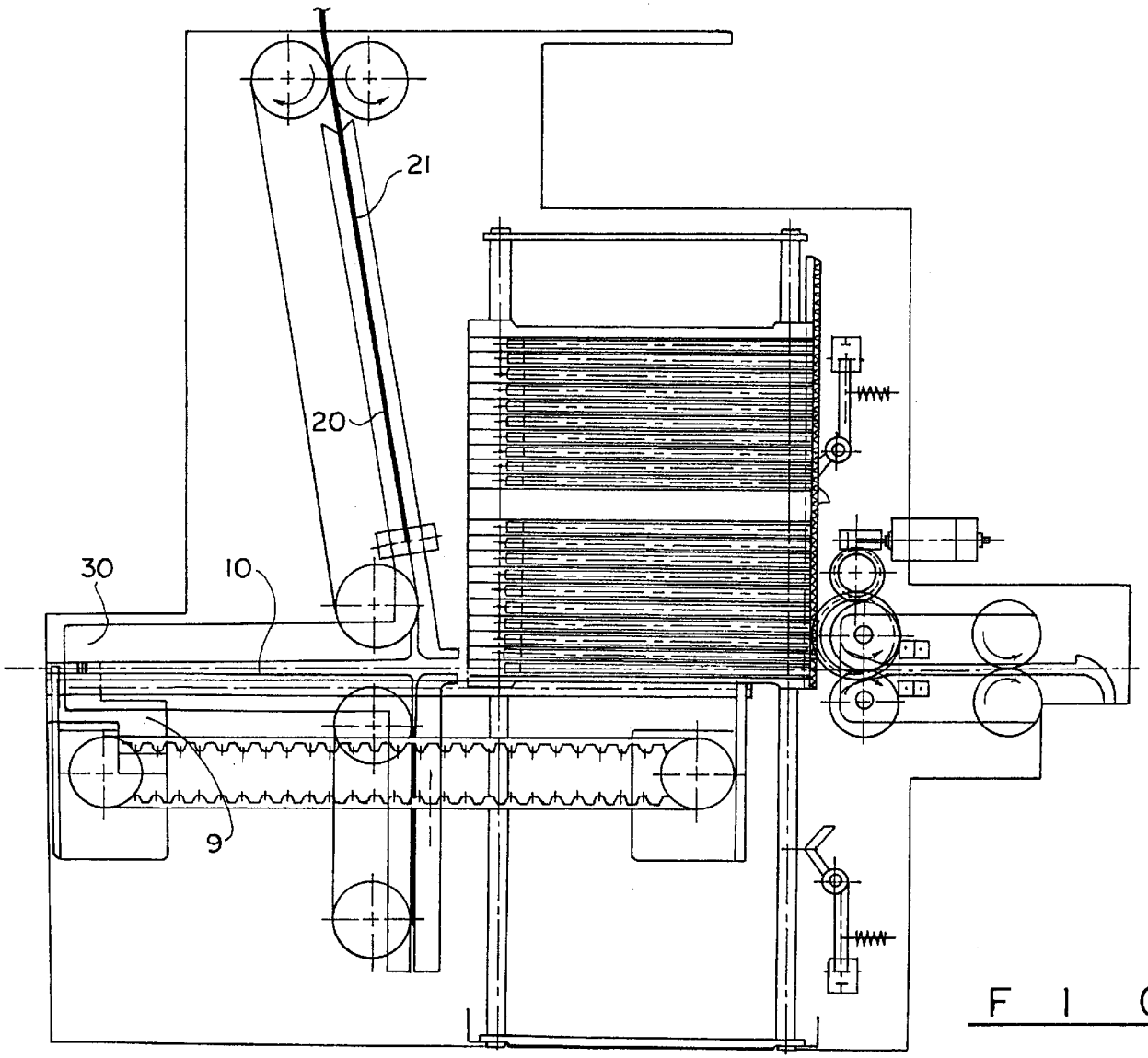
Figure 4:
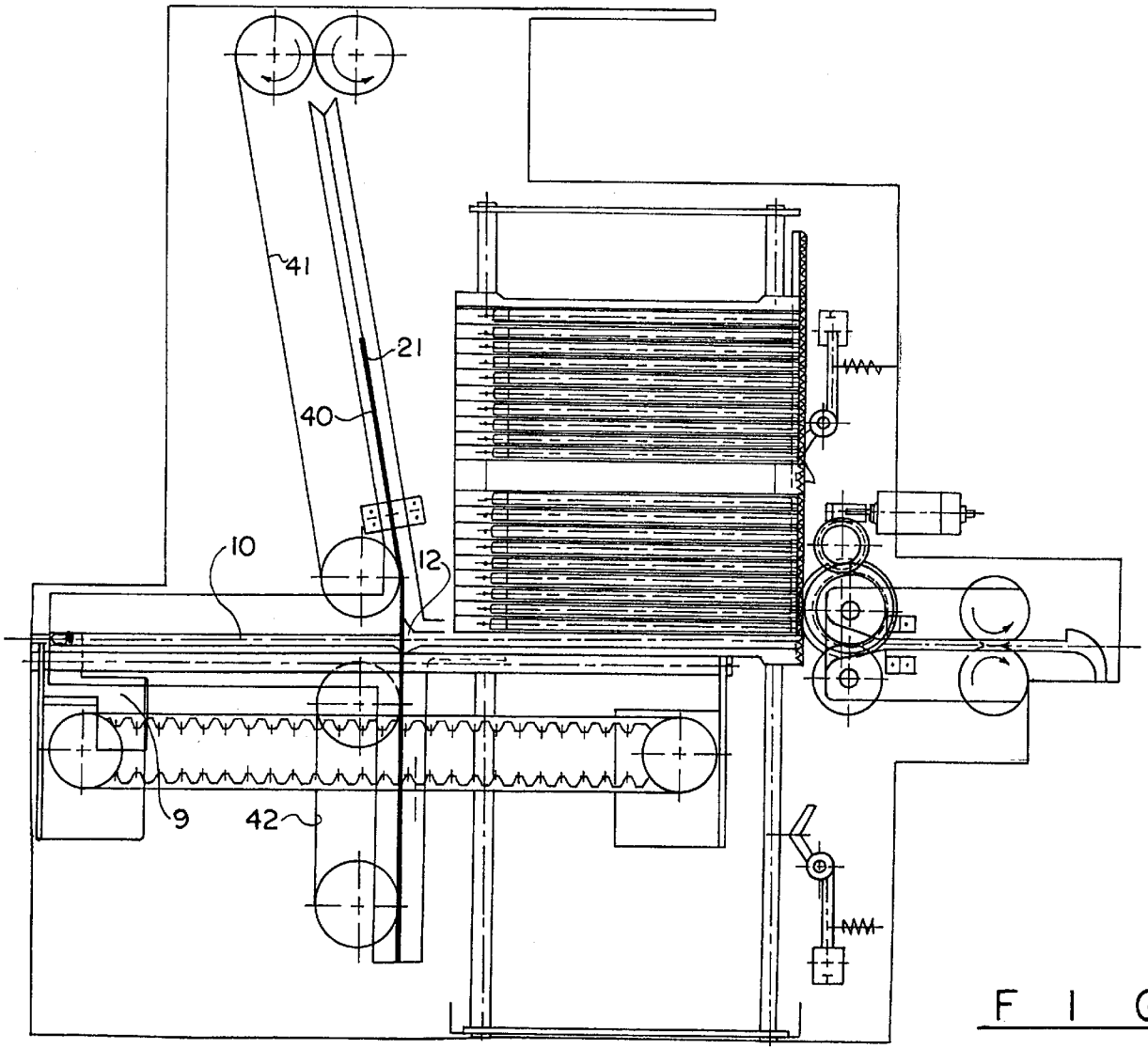
Figure 5:
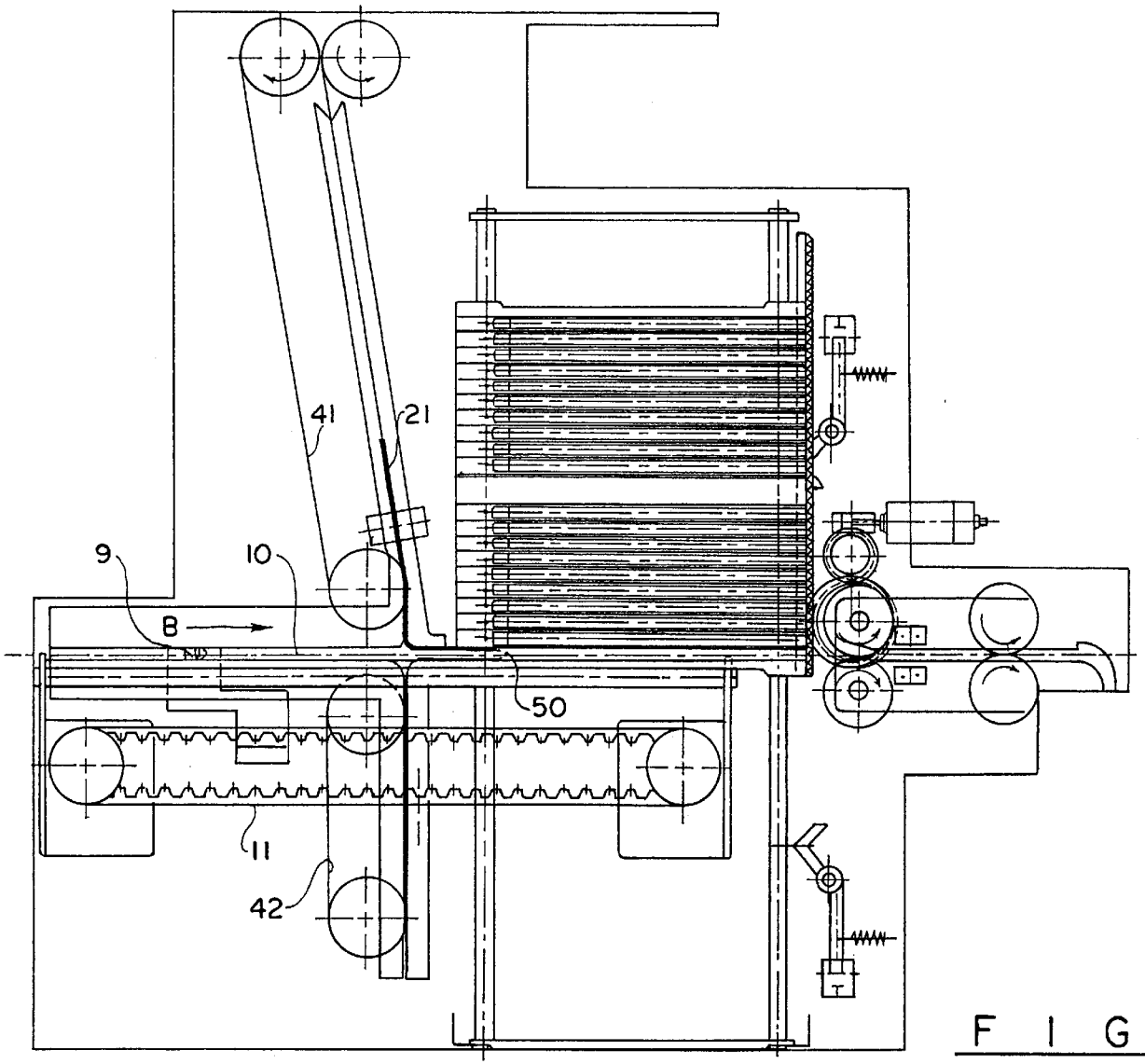
Figure 6:
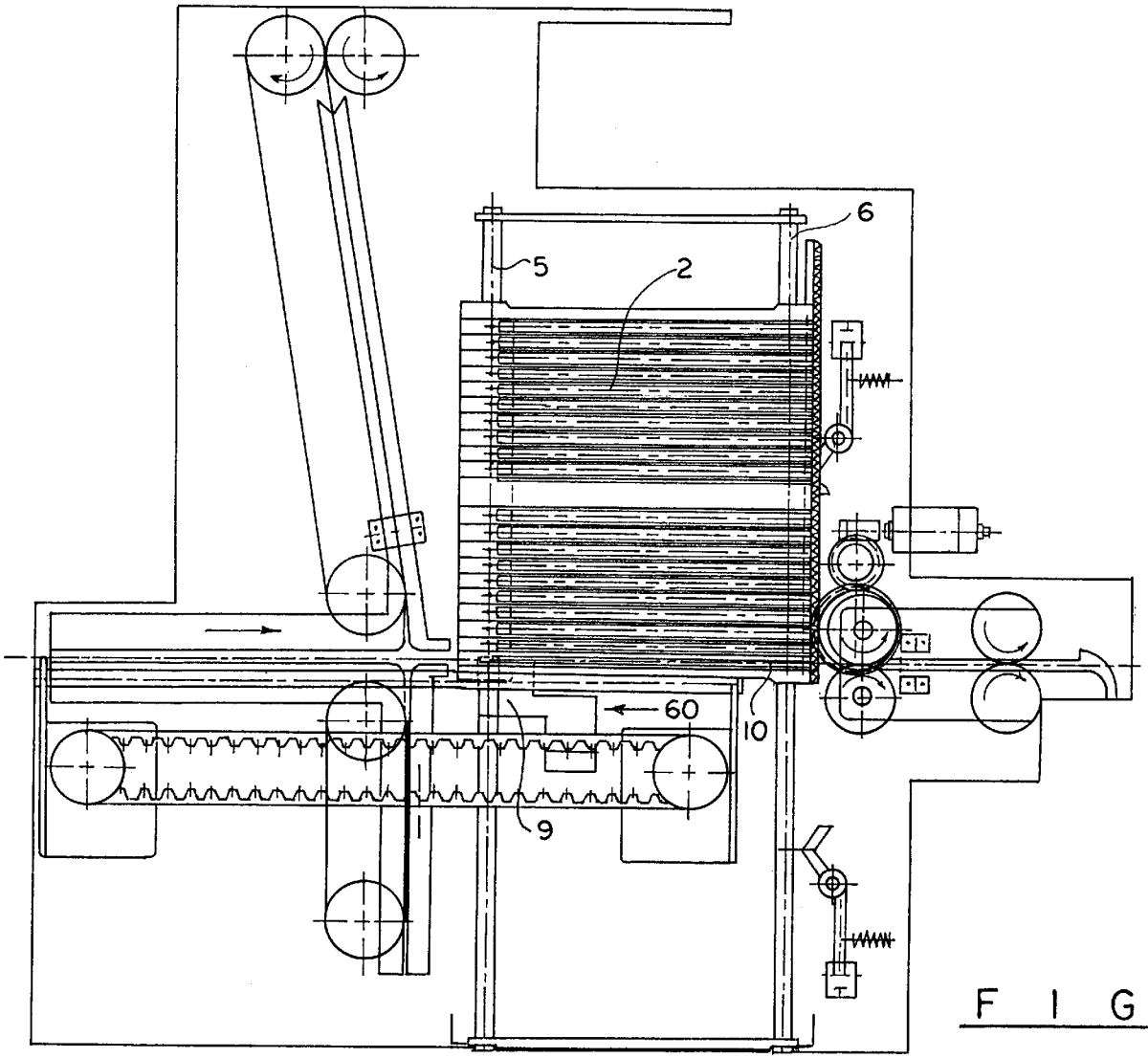
Figure 7:
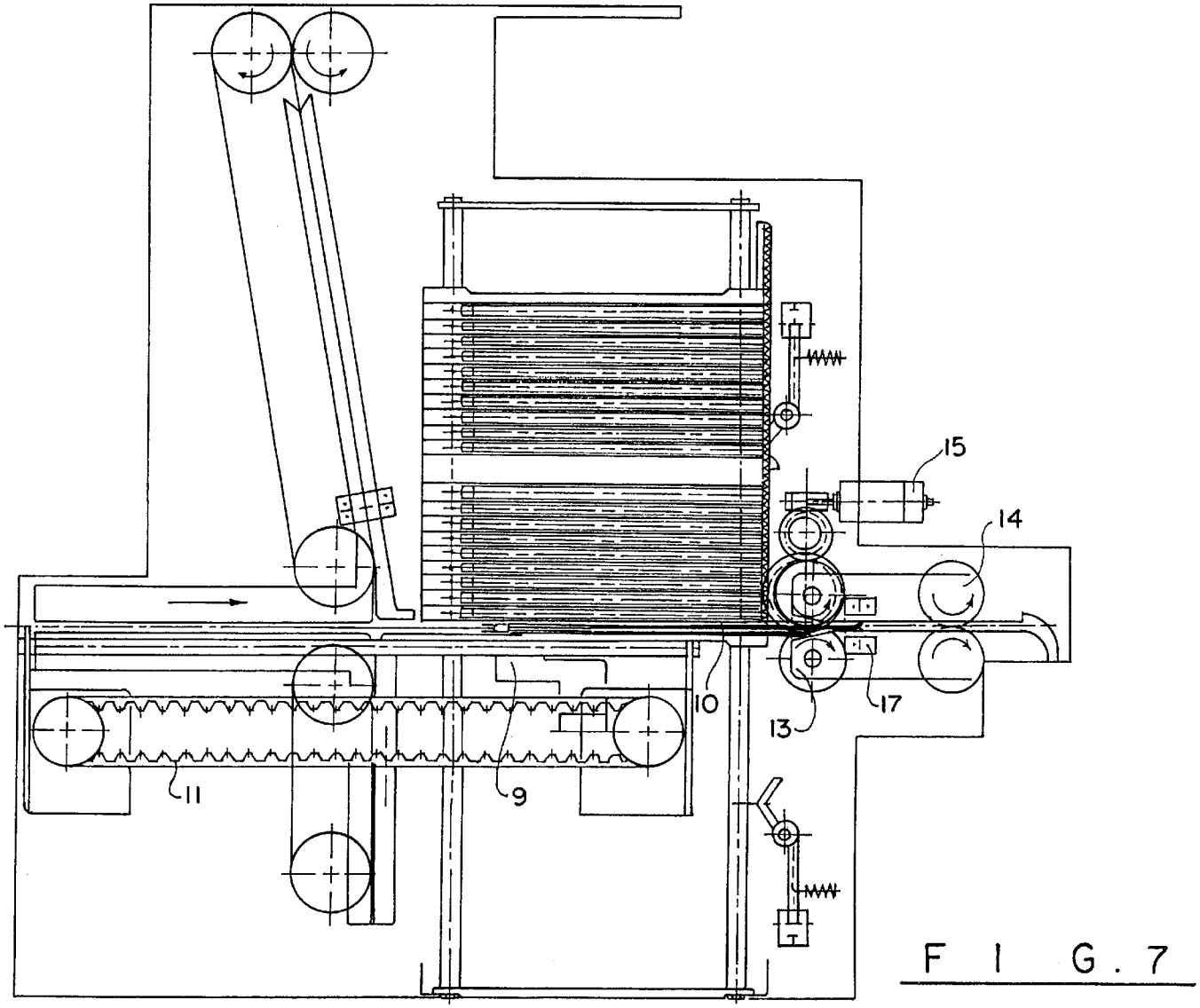
Figure 8:
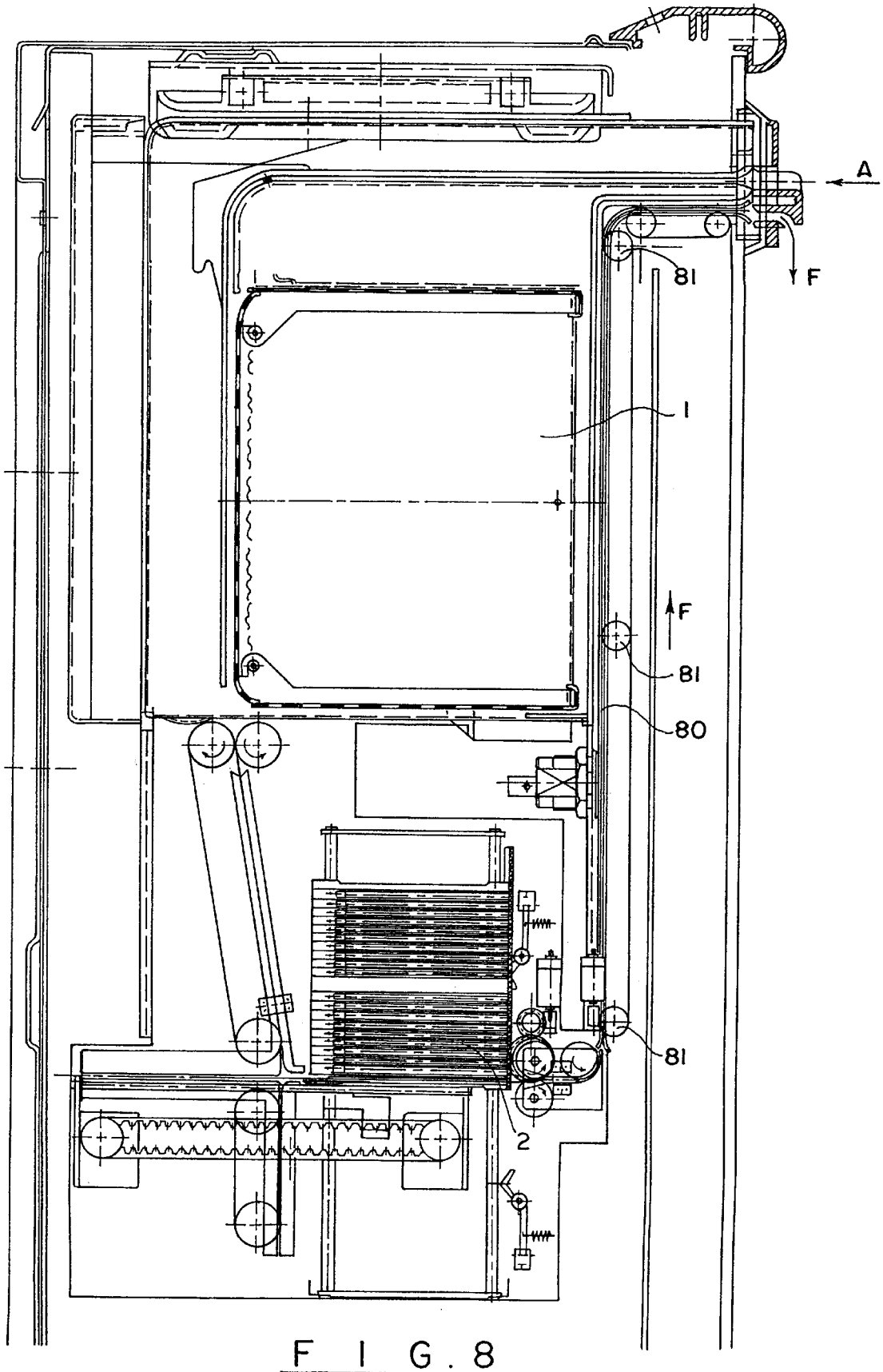
Figure 9:
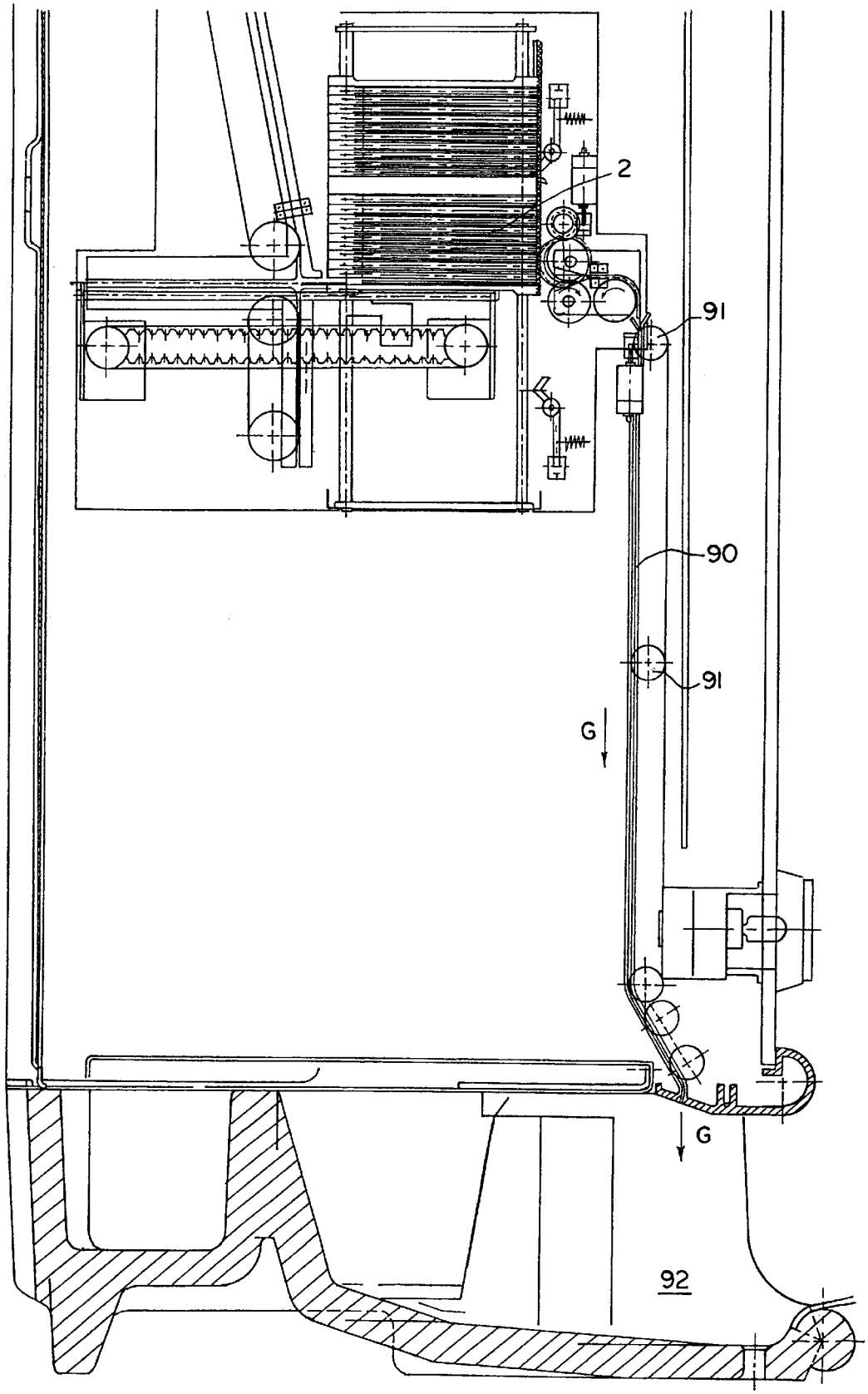

One embodiment of the invention is described in detail below by means of the drawing. In which FIG. 1 shows a cross-section through the apparatus for the storage and dispensing of bank notes;

FIG. 2 shows the position of the bank note after passing through the bank note tester;

FIG. 3 shows the situation of FIG. 2 with the slider in the standby position;

FIG. 4 shows the bank note in the holding position for the folding process;

FIG. 5 shows a partially folded bank note prior to insertion in the compartment module;

FIG. 6 shows a compartment module with an inserted bank note;

FIG. 7 shows the dispensing of a bank note from the compartment module;

FIG. 8 shows an apparatus having a bank note insert and a bank note dispenser below it; and FIG. 9 shows an apparatus having a bank note dispenser at the pay-out cup.

FIG. 1 shows a cross-section through the apparatus for the storage and dispensing of bank notes. The apparatus in accordance with the invention possesses a bank note tester 1 such as is known from DE 40 05 291 C2. The device known per se for the verification and storage of bank notes 1 and the compartment module 2 in accordance with the invention for the storage and dispensing of bank notes are fitted in the form shown in a common housing.

The housing possesses an insertion slit 3 for the bank notes to be verified and stored in which the bank notes are inserted singly in the direction of the arrow A. The bank notes are conveyed along the indicated path 4 during which they pass the bank note tester 1 along the transport path C.

After passing the bank note tester 1, the corresponding bank note is pulled in by the intake roller pair 18 and conveyed along the transport path D until the front end of the bank note reaches the light barrier 19.

The apparatus for the storage of the bank notes comprises a compartment module 2, which is guided vertically on guide rods 5, 6. The stop levers 7, 8 ensure here that the compartment module 2 is moved along the guide rods 5, 6 in appropriate steps by a motor not shown in detail.

The compartment module 2 is fitted in its compartment with sword-like sliders 10. Thanks to the slider, the bank notes to be stored can be inserted into the compartments while being folded over in a loop-like manner after the corresponding compartment has been travelled to the middle plane of the bank note to be stored by the controlled drive. To move the slider, a drive carrier 9 is provided which can be travelled by means of the toothed belt drive 11. By means of the driver carrier 9, the relevant driver can thus be guided in a horizontal direction along the guide 12.

On the output side of the compartment module there are located extraction roller pairs 13, 14 with which the relevant bank note can be extracted from the compartment module 2 and conveyed along the transportation path E to the bank note dispenser.

FIG. 2 shows the position of a bank note after passing through the bank note tester. At position 20 the bank note 21 is stopped, with the reaching of position 20 being detected by the light barrier 19. If the bank note is released by the bank note tester, the bank note 20 is transported on for storage in the compartment module. In the other case, the bank note 21 is, in contrast, transported back to the bank note insert 3 and output there.

FIG. 3 shows the situation of FIG. 2 with a slider in standby position. As soon as a bank note 21 is released at position 20 of FIG. 2, the drive carrier 9 having a slider 10 attached to it is travelled to the standby position 30 shown in FIG. 3. The bank note 21 is here held at position 21 until the slider has completely assumed the standby position 30.

FIG. 4 shows the bank note in the holding position for the folding process. From the position 20 of FIG. 2 or FIG. 3, the bank note is here travelled to position 40 by the belt drives 41, 42. At this position, the bank note is located approximately centrally to the guide slit 12.

FIG. 5 shows a partially folded bank note prior to insertion in the compartment module. The drive carrier 9 is here moved along the displacement path B by the toothed belt 11 and presses the slider against the bank note 21 clamped between the toothed belts 41 and 42. At the position 15 shown, the centrally folded bank note is just being inserted into a free compartment of the compartment module 2. The belt drive 41 can here be swivelled away so that the bank note 21 is in the slit without any clamp strain.

FIG. 6 shows the compartment module with an inserted bank note. As can be seen more precisely in FIG. 6, the compartment module 2 is fully equipped with sliders in each of its compartments. The lowest slider 10 bears in this case a folded bank note after the bank note was inserted completely into the compartment from position 50 of FIG. 5 by the drive carrier 9 and the slider 10. At the shown position 60 of the drive carrier 9, it is now also possible for the compartment module to be travelled up and down along the guide rods 5, 6 in order to select another compartment for loading and unloading.

FIG. 7 shows the dispensing of a bank note from the compartment module. By means of the belt drive 11, the drive carrier 9 is here travelled to the extreme right end position to the extraction roller pair 13 with the selected slider. In this way, the extraction rollers 13 can grip the note and pull it down from the slider 10. Preferably, the slider possesses for this purpose a corresponding recess so that the slider can travel past to the left and right of the rollers with the recesses so that the note can be gripped without the slider located therebetween. The bank note is further folded by the extraction roller pair 13, 14 and pressed into the following transportation channel.

FIG. 8 shows the apparatus in accordance with the invention having a bank note insert and a bank note dispenser located underneath each other. The dispensed bank note is pressed into the transportation channel 80 and transported on from their by means of a roller system 81 with toothed belts along the transportation path F to the bank note dispenser.

FIG. 9 shows the apparatus in accordance with the invention having a bank note dispenser ending in the region of a pay-out cup 92. In accordance with FIG. 8, the folded bank note is pressed into the transportation channel 90 and transported on by means of a roller system 91 along the transportation path G to the bank note dispenser from where the note falls into the pay-out cup 92 and can be removed from there.

What is claimed is:

1. An apparatus for storage and dispensing of bank notes, comprising, a compartment module having several compartments arranged adjacent to one another to move as a unit, each said compartment structured and arranged to receive a single note, partitions arranged to separate each said compartment from an adjacent compartment, each said compartment open at opposite ends thereof between said respective partitions, said compartment module together with said individual compartments thereof forming a magazine, guides upon which said compartment module is movably and reciprocatingly arranged in a direction substantially perpendicular to both opposite open ends of each said compartment, a slider reciprocatingly movable and arranged for storage of the bank notes within said magazine, said magazine and slider positioned with respect to one another with said slider structured and arranged to push each said bank note positioned in front of an opening of a respective compartment of said magazine into said respective compartment and fold said respective bank note in a substantially transverse middle plane thereof, with said respective compartment positioned substantially adjacent said transverse middle plane of said respective bank note, such that each said bank note is inserted into said respective compartment in folded condition along said substantially transverse middle plane thereof and retained therein in flat and folded condition, and for dispensing of a respective bank note, said magazine with said compartment storing the same is movable to a position to dispense the same from the respective opposite end opening of said compartment, wherein said compartment module is reciprocatingly arranged upon said guides to move in a direction substantially normal to said reciprocatingly movable direction of said slider, with said slider structured and arranged to fold and insert said respective bank note into said compartment in an insertion end of said two opposite ends of each said compartment, and additionally comprising a gripper structured and arranged to grip and extract said respective bank notes from said respective compartments from the opposite extraction end of each said compartment, over a loop in a region of a fold crease in the respective bank note.

2. An apparatus in accordance with claim 1, additionally comprising a device connected in series with said compartment module for verification of the inserted bank notes, a conveying device structured and arranged to position flat bank notes in front of said insertion side, opening of the respective compartment of the compartment module in position to be folded by said slider into said respective compartment, and a dispensing device structured and arranged to receive a respective bank note in front of the opposite opening of said respective compartment when said compartment is moveably positioned adjacent the same.

3. An apparatus in accordance with claim 2, wherein said dispensing device comprises an extraction roller pair.

4. An apparatus in accordance with claim 3, additionally comprising a transportation device structured and arranged after said extraction roller pair, and comprising driven belts under which the folded bank notes are transported.

5. An apparatus in accordance with claim 1, wherein dispensing and inserting the bank notes takes place through the same slot.

6. An apparatus in accordance with claim 1, wherein dispensing of the bank notes takes place at a dispensing slot located below a separate insertion slot for the bank notes into said apparatus.

7. An apparatus in accordance with claim 1, wherein dispensing of the bank notes takes place at a pay-out cup.

8. An apparatus in accordance with claim 2, wherein drives are provided for the compartment module, the slider and the dispensing device, and additionally comprising a micro-computer structured and arranged to control all said drives.

9. An apparatus in accordance with claim 1, additionally comprising a bank note tester structured and arranged to be coupled along an intake slot for the bank notes in said apparatus.

10. An apparatus in accordance with claim 1, in which said guides are in the form of rods upon which said compartment module is situated to be moveably guided.

11. An apparatus in accordance with claim 1, wherein said slider is structured and arranged to contact said respective bank note at the substantially transverse middle plane thereof and push said respective bank note into said respective compartment.

* * * * *